US005579734A

United States Patent [19]

Muth

[11] Patent Number: 5,579,734

[45] Date of Patent: Dec. 3, 1996

[54] ROTARY VALVE INTERNAL COMBUSTION ENGINE

[76] Inventor: Barry A. Muth, 129-C Farrington Rd., Raleigh, N.C. 27615

[21] Appl. No.: 387,182

[22] Filed: Feb. 13, 1995

[51] Int. Cl.[6] ..... F02M 57/04; F01L 7/06

[52] U.S. Cl. ..... 123/296; 123/80 D; 123/80 BB; 123/190.14; 123/190.15

[58] Field of Search ..... 123/190.1, 190.4, 123/190.5, 190.14, 190.15, 80 R, 80 BB, 80 D, 296

[56] References Cited

U.S. PATENT DOCUMENTS

| | | | |
|---|---|---|---|
| 3,906,922 | 9/1975 | Dane, Jr. | 123/190.4 |
| 3,945,359 | 3/1976 | Asaga | 123/80 BB |
| 4,149,498 | 4/1979 | Ferrell | 123/80 D |
| 4,279,225 | 7/1981 | Kersten | 123/80 BB |
| 4,370,955 | 2/1983 | Ruggeri | 123/190.6 |
| 4,815,428 | 3/1989 | Bunk | 123/190.8 |
| 5,000,136 | 3/1991 | Hansen et al. | 123/80 BB |
| 5,154,147 | 10/1992 | Muroki | 123/190.17 |
| 5,377,635 | 1/1995 | Glover | 123/190.1 |

FOREIGN PATENT DOCUMENTS

| | | | |
|---|---|---|---|
| 4324263 | 12/1993 | Germany | 123/80 R |

*Primary Examiner*—Erick R. Solis

[57] ABSTRACT

A rotary valve engine includes an engine block having at least one combustion chamber which is sealed by a rotary valve which also can function as a head. The rotary valve includes an intake passage and an exhaust passage for directing intake air into the combustion chamber and for exhausting combustion gases from the combustion chamber as the valve rotates. In a preferred embodiment of the invention, a single rotary valve is associated with a plurality of combustion chambers for directing intake air into the combustion chambers and exhaust gases from the combustion chambers in succession as the valve rotates. Also, in a preferred embodiment of the invention, a spark plug and fuel injector are mounted on the rotary valve for injecting and igniting fuel in each combustion chamber.

17 Claims, 7 Drawing Sheets

ROTARY VALVE INTERNAL COMBUSTION ENGINE

FIELD OF THE INVENTION

The present invention relates generally to internal combustion engines, and more particularly, to an internal combustion engine utilizing a rotary valve for directing the flow of intake air into the cylinders and exhausting gases from the cylinders.

BACKGROUND OF THE INVENTION

The four stroke internal combustion engine has changed little since its inception over 100 years ago. The 1973 energy crisis spurred public and governmental requirements for more fuel-efficient automobiles during the 1970's. Increases in fuel efficiency were brought about primarily by the introduction of small displacement engines and smaller, lighter weight automobiles. The Japanese, already manufacturing autos with these characteristics, quickly gained market share at the expense of U.S. automakers. However, all of these down-sized automobiles lacked an important consumer want, good acceleration. To satisfy this complaint, manufacturers used several methods to increase output while still meeting government mandated mileage levels. Primarily, these methods included using already developed performance enhancing technologies such as the use of larger valves, higher compression ratios, higher r.p.m.'s, more valves per cylinder, and super-charging or turbo-charging. While these efforts produced engines with outputs comparable to pre-1973 levels and good fuel economy, they are also very costly to produce.

Today, another crisis is emerging in the form of increasing requirements for reducing emissions from vehicles. The most efficient method to reduce emissions is not to produce them in the first place. In this regard, electric vehicles may eventually prove successful, but as of now, technical problems remain and these vehicles will likely be costly to produce. On the other hand, reducing emissions produced by current engines is most effectively done by burning less fuel which in turn is most effectively accomplished by reducing engine displacement. As conventional poppet engines are reaching the limits of development, this would seem to imply a return to the poor performance automobiles of the seventies. While some performance gains can be recaptured through reduced vehicle weight and other technical improvements, it is expected that the resultant vehicle will not match current performance levels and be more costly to produce. This trade-off creates a difficult dilemma for the auto manufacturer. The public demand for clean air on one hand must be balanced against individual consumer demands for high performance and low costs on the other.

What is needed to meet the dilemma resulting from society's demand for lower emission engines is a compact, lightweight engine capable of producing markedly increased output per liter without increasing costs. Then, a smaller displacement version of this "superengine" could match current performance levels and allow any cost savings from the engine to offset cost increases incurred by other fuel conserving measures. In this manner, both the public demand for lower emissions and the individual consumer demands for performance and can be met at no additional costs.

SUMMARY AND OBJECTS OF THE INVENTION

The present invention is an internal combustion engine having a plurality of cylinders each containing a reciprocating piston connected to a rotating crankshaft. A rotary disk valve is located over the top of the cylinders for rotation about an axis parallel to the axis of the cylinders. The center of each cylinder is equally spaced from the axis of rotation of the rotary disk valve. The valve includes an intake passage for directing intake air into the cylinders and an exhaust passage for exhausting combustion gases from the cylinders. The intake passage and exhaust passage in the rotary valve communicate with each cylinder in succession as the valve rotates, allowing the use of a single valve for all four cylinders. Seals disposed around each cylinder press against the bottom surface of the valve to prevent the escape of combustion gases from the cylinder. In a preferred embodiment of the invention, the pressure of the seals against the bottom surface of the rotary valve is varied during each cycle of the engine. The pressure is lowest during the intake stroke and is highest during the power stroke.

In another aspect of the invention, the spark plug or other ignition device is mounted on the rotary valve. The spark plug is positioned on the valve so that it is centrally located over the piston at the moment of ignition. A fuel injector can also be mounted on the rotary valve for injecting fuel into the cylinder. Locating the injector on the valve can produce a stratified charge useful for lean burn conditions. The injectors could be placed just behind the intake port or in the intake passage, allowing injection of fuel during the compression or intake strokes.

In yet another aspect of the present invention, the pistons have a concave mid-section giving the pistons an hourglass shape. The reduced diameter mid-section dramatically reduces skirt friction and allows better lubrication of upper portions of the piston reducing ring friction. This design is also highly resistant to the effects of "bulging" and "wobbling".

Based on the foregoing, it is a primary object of the present invention to provide a rotary valve engine which has greater fuel efficiency and higher engine output as compared to conventional poppet valve engines.

It is another object of the present invention to provide a rotary valve engine which has higher volumetric efficiencies as compared to conventional poppet valve engines.

Still another object of the present invention is to provide a rotary valve engine which reduces friction losses as compared to conventional poppet valve engines.

Another object of the present invention is to provide a rotary valve engine which will allow higher compression ratios and higher r.p.m.'s than conventional poppet valve engines.

Another object of the present invention is to provide a rotary valve engine which will be relatively inexpensive to produce.

Yet another object of the present invention is to provide a rotary valve engine which greatly reduces exhaust emissions.

Another object of the present invention is to provide a rotary valve engine having a compact and lightweight design.

Another object of the present invention is to provide a rotary valve engine having a relatively small number of moving components.

Still another object of the present invention is to provide a rotary valve engine which is well suited for use with alternative fuels including methanol, ethanol, natural gas and others, as well as conventional fuels such as gasoline and diesel.

Other objects and advantages of the present invention will become apparent and obvious from a study of the following description and the accompanying drawings which are merely illustrative of such invention.

DETAILED DESCRIPTION OF THE INVENTION

Figure 1:
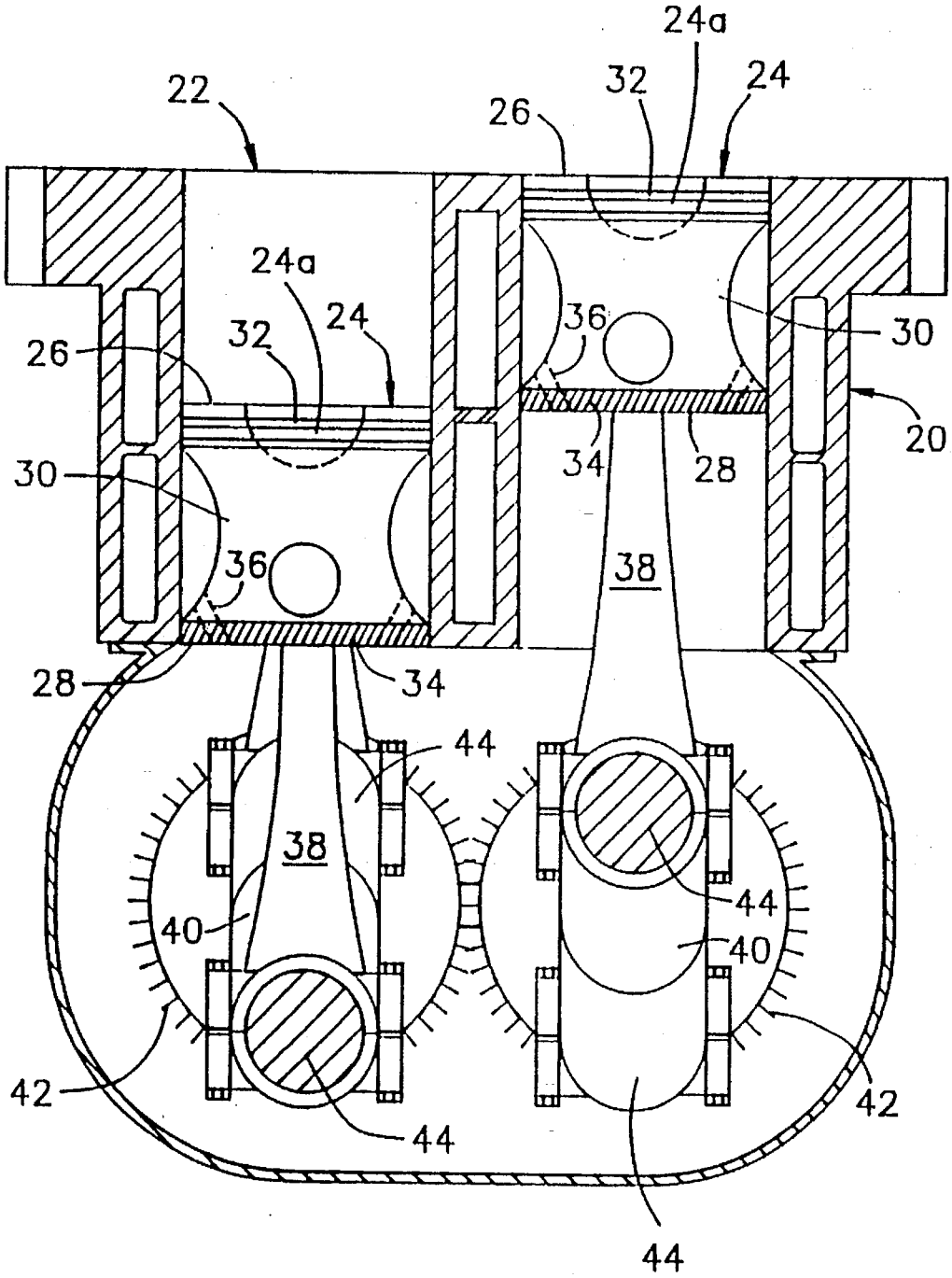
FIG. 1 is a cross-section through the engine block of the rotary valve engine of the present invention.

Referring now to the drawings, the rotary valve engine of the present invention is shown therein and indicated generally by the numeral 10. The rotary valve engine 10 includes an engine block 20, shown in FIGS. 1 and 2, indicated generally at 20 having a plurality of cylinders 22 in which reciprocating pistons 24 are mounted. A rotary valve assembly 70, shown in FIG. 3, is disposed on the top of the engine block 20 for directing a fuel/air mixture into the cylinders 22 and exhausting combustion gases. The rotary valve assembly 70 comprises a valve housing 100 secured to the engine block and a single, disc-type rotary valve 72.

Figure 2:
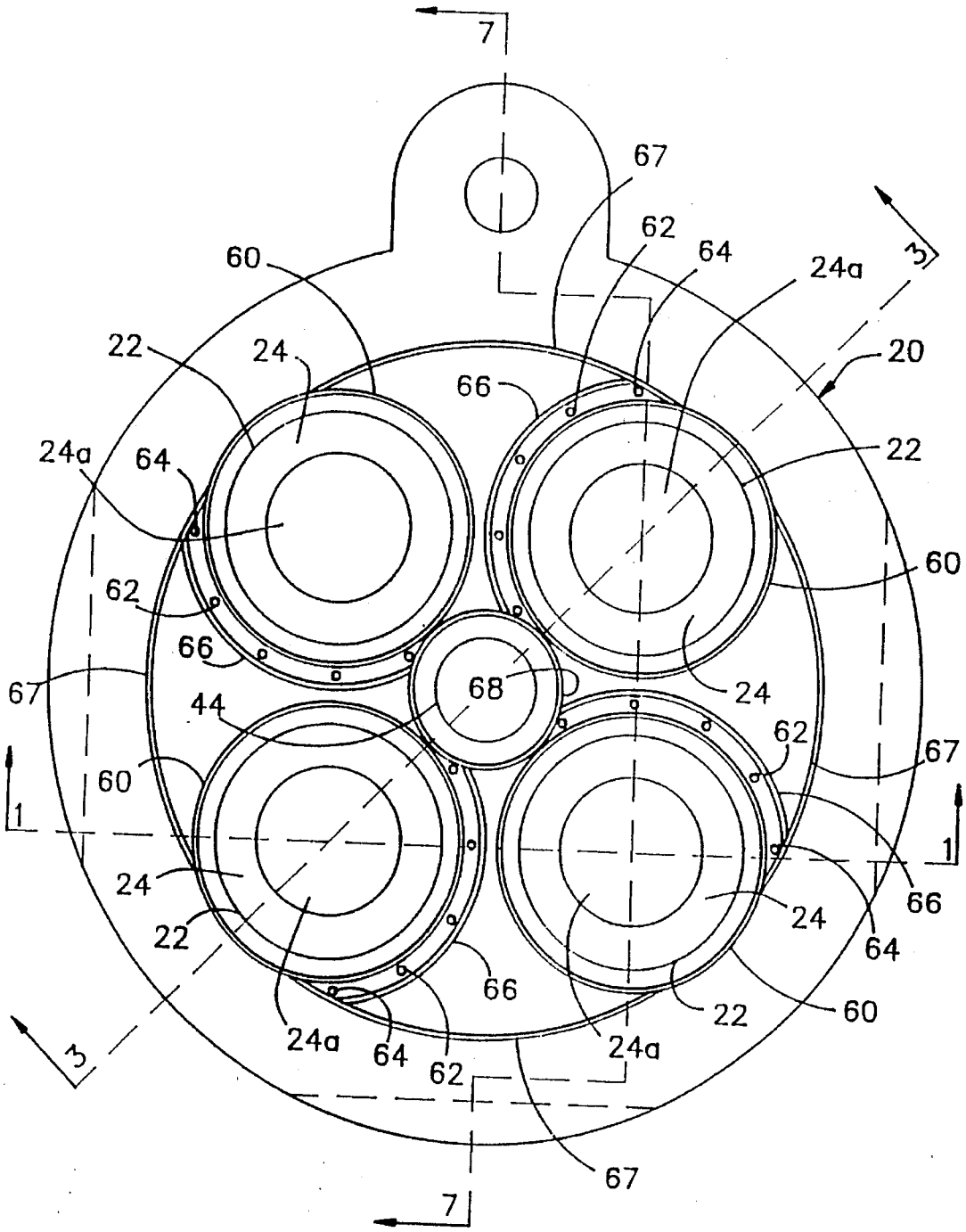
FIG. 2 is a top plan view of the engine block.
Figure 3:
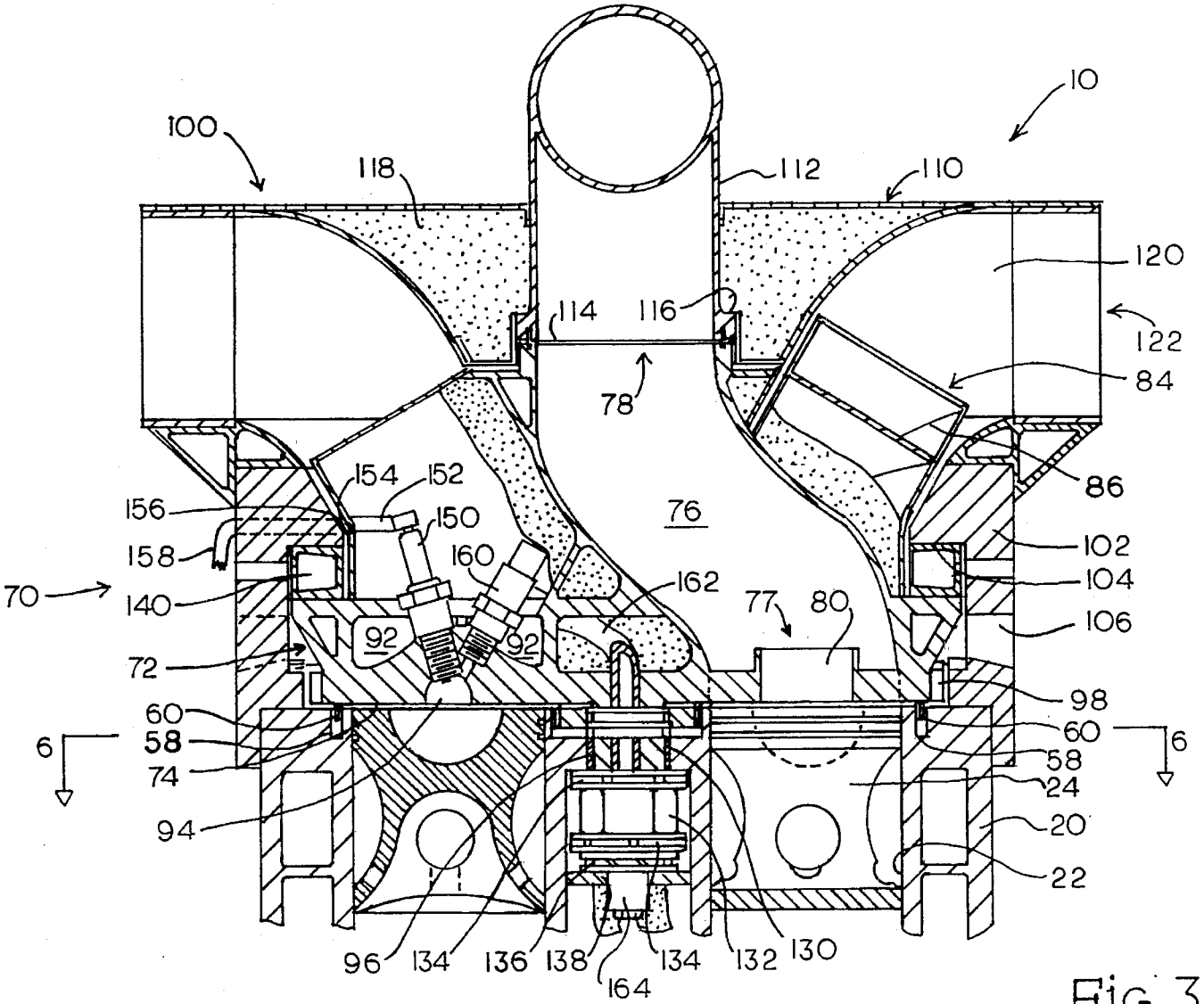
FIG. 3 is a cross-section showing the valve assembly of the rotary valve engine.

The engine block 20 has a generally circular configuration with four cylinders 22 circumferentially spaced about the axis of rotation of the valve 72 (FIG. 2). The center of each cylinder 22 is equidistant from the rotation axis of the valve 72. A piston 24 is mounted for reciprocating movement within each cylinder 22. Each piston 24 includes a generally circular top portion 26, a generally circular bottom portion 28, and a concave midsection 30 which gives the piston 24 an hour-glass shape (FIG. 1). This concave shape minimizes the piston skid surface area which contacts the cylinder walls yet still provides for a stable platform to counter forces which create wobbling. Oil and compression rings 32 are fitted in grooves in the top portion 26 of the piston 24 in a conventional manner. A bowl 24*a* is also formed in the top surface of the piston 24. Oil drain holes 36 and grooves 34 extend from the bottom section 28 into the mid-section 30 to allow engine oil to enter and exit the space surrounding the mid-section 30. The unique piston design reduces the effects of skirt friction, ring friction, wrist pin friction, bulging, and wobbling.

Each piston 24 is connected by a piston rod 38 to a rotating crankshaft 40. The disclosed embodiment has two, parallel crankshafts 40 with geared flywheels 42 which are meshed with one another. Thus, the crankshafts 40 will rotate in opposite directions. Each crankshaft 40 includes two crank throws 44 to which respective piston rods 38 are connected. The crank throws 44 on each crankshaft 40 are disposed 180° apart from one another. Thus, even though the circular path of travel of the crank throws on opposite crankshafts can overlap, the crank throws avoid contact by being out-of-phase with one another. This allows the crankshafts to be placed closer together. In addition, compared to an inline configuration, this twin crankshaft design decreases each crankshaft length by two thirds or the combined length of both crankshafts by one third. Not only does this latter configuration produce a much more compact design, but one that is stiffer and of less mass as well.

The rotary valve assembly 70, shown in FIG. 3, is mounted on top of the engine block 20. The valve assembly 70 includes a single disc-type valve 72 which is mounted for rotation on the engine block 20, and a valve housing 100 which encloses the valve 72. The rotary valve 72 has a flat bottom surface 74 and is large enough to cover all four cylinders 22. The valve 72 includes an exhaust passage 76 and an intake passage 84. The exhaust passage 76 includes an inlet 77 on the bottom 74 of the valve 72 and an outlet 78 at the top of the valve 72 along the axis of rotation of the valve 72. The inlet 77 of the exhaust passage 76 is positioned such that it communicates with each cylinder 22 in succession as the valve 72 rotates. Compounding fins 80 extend across a portion of the inlet 77 of the exhaust passage 76. The function of the compounding fins 80 will be described below.

Figure 4:
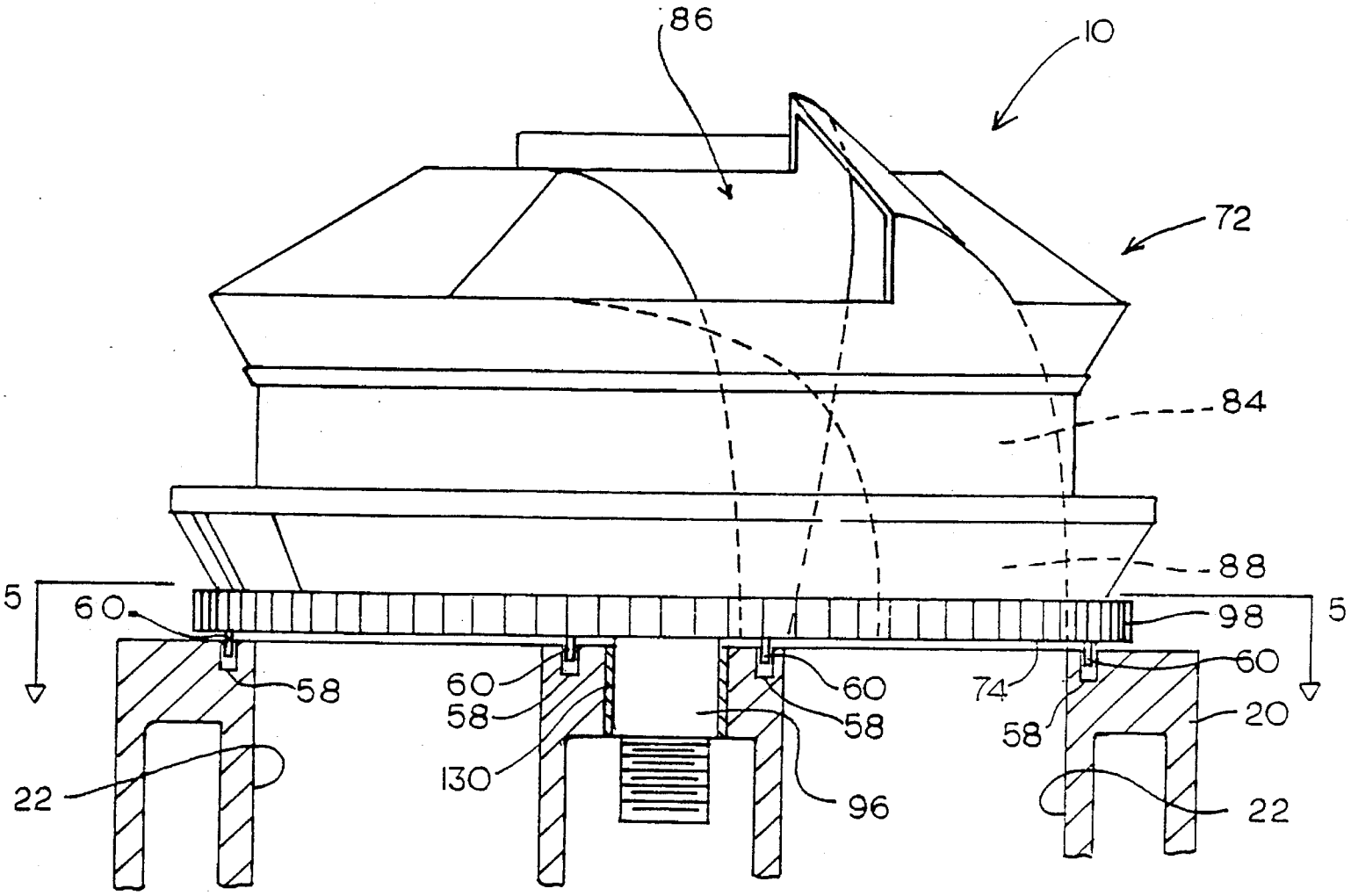
FIG. 4 is an elevation view of the rotary valve mounted on top of the engine block which is shown in section.

The intake passage 84, seen best in FIG. 4, includes an inlet 86 disposed on the top of the valve 72 adjacent to the outer circumference 72 and an outlet 88 on the bottom 74 of the valve 72. The inlet 86 faces the direction of rotation of the valve 72 so that it functions somewhat like an air scoop as the valve 72 rotates, creating pressure that forces air down through the intake passage 84 into the cylinders 22.

The valve 72 is rotatably mounted to the engine block 20 and is enclosed by the valve housing 100 (FIG. 3). A shaft 96 extends downwardly from the bottom 74 of the valve 72 and is received in the center hole of the engine block 20. The shaft 96 is rotatably journalled in a bearing 130 which is pressed into the center hole 44 of the engine block. The valve 72 is secured in place by a nut 132 which threads onto the end of the shaft 96. A flat bearing 134 is inserted over the end of the shaft 96 before applying the nut 132. This nut may not be necessary in smaller diameter valves. The bearing 134 abuts against a downwardly facing shoulder within the center hole 44 of the engine block 20.

In a preferred embodiment of the invention, a compression spring 136 is inserted into the center hole of the engine block and rests on a brace 138. The compression spring 136 exerts an upwardly directed force on the valve 72 to lessen the pressure of the valve 72 on the seals surrounding the cylinders 22, when the engine is not in operation and to allow thermal expansion of the valve during operation.

Of critical importance is the seal system depicted in FIG. 2. Most rotary valve engines are unsuccessful due to their inability to adequately seal the combustion chamber without excessive friction or excessive oil consumption. This problem is overcome by the cylinder seals 60 which are based on an improved version of the side seals successfully used for over thirty years in the Wankel rotary engine. The cylinder seals 60 fit into circular grooves 58 surrounding each cylinder 22. The seal system shown in FIG. 2 is superior to the Wankel System for several reasons. First, a single "0" ring seals the entire combustion chamber providing a stronger seal without gaps. Second, the seals 60 are lubricated outside the combustion chamber by nozzles 62 with excess oil draining through holes 64 early in the compression stroke minimizing oil consumption while providing a better seal. While this represents the preferred embodiment, advances in materials technology may obviate the need for this feature. Lastly, the cylinder seal friction is reduced by the use of a variable pressure seal system. Seals 66, 67, and 68 are oil seals under constant, but minimal pressure, produced by conventional means. Also, these seals can be reduced in size or eliminated depending upon other engineering constraints.

Figure 6:
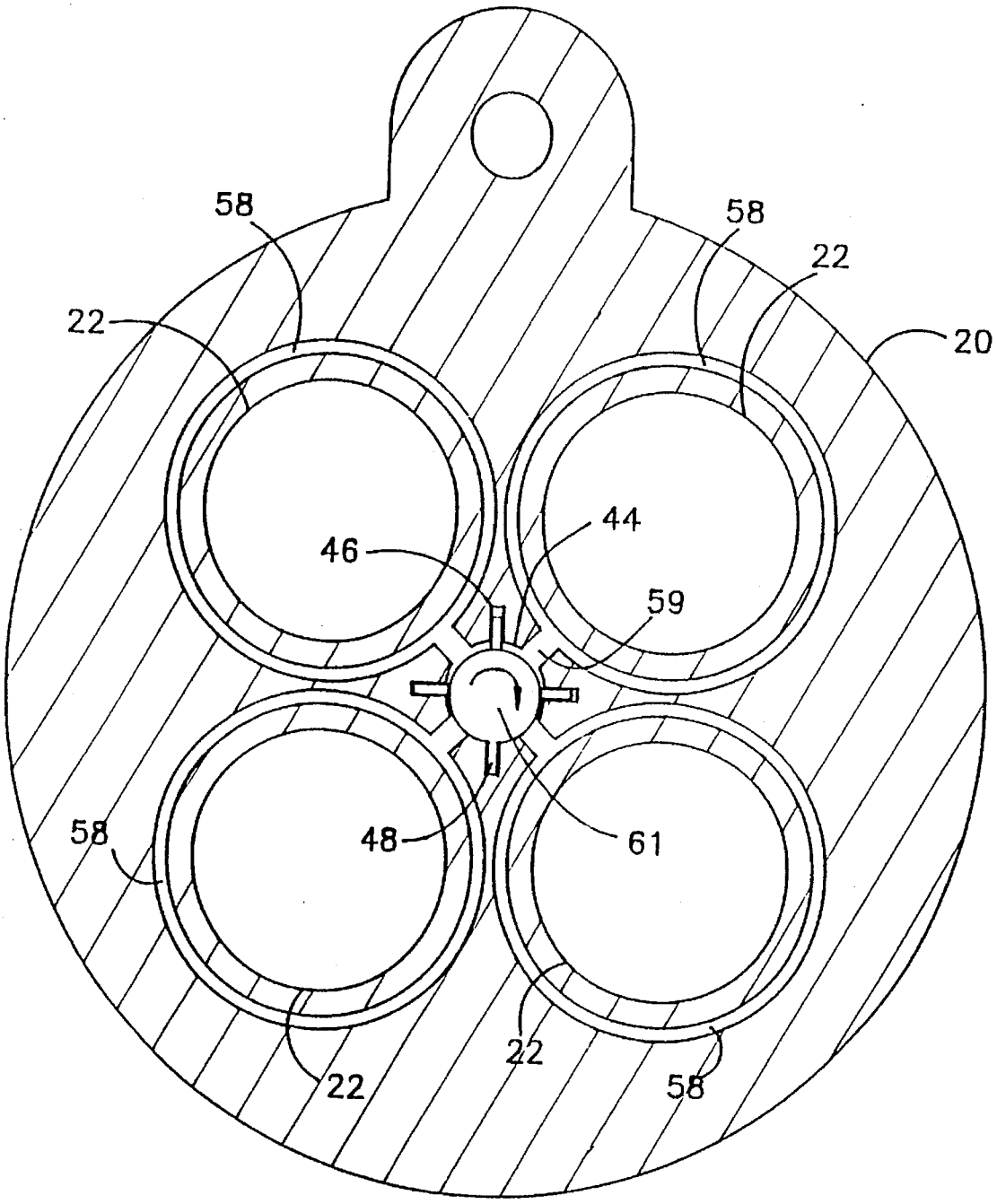
FIG. 6 is a section view of an engine block incorporating the variable pressure seal system taken through line 6—6 of FIG. 3.

FIG. 6 illustrates the components of an optional variable pressure seal system. Encircling the tops of the cylinders 22 are ring channels 58 that communicate via connecting passages 59 with a center hole 44, all of which are filled with oil. Seated within each ring channel 58 above the oil is a cylinder seal 60, which is biased upwardly against the underside of the valve 72 by pressurized oil, as will be explained below. An off-center cam 61 attached to the valve shaft 96 rotates within the center hole 44 to variably pressurize the oil below the cylinder seals 60 of each cylinder 22 as the valve 72 turns. The oil to each cylinder seal 60 is pressurized and thus a particular cylinder seal 60 is biased upwardly to provide a tight seal during the power stroke of that cylinder 22. During the other cycles of that cylinder 22 when such a tight seal is not essential, the pressure to its cylinder seal 60 is relaxed, thereby reducing unnecessary friction between the cylinder seal 60 and the rotating valve 72. Extending radially outward from the center hole 44 are slots 46 in which are seated cam seals 48. These cam seals 48 are biased against the cam 61 by springs or the like to prevent pressurized oil from leaking around the cam 61 as the cam 61 rotates.

Returning to FIG. 3, the valve 72 is enclosed by the valve housing 100. The valve housing 100 includes a ring structure 102 and a manifold 110. The ring structure 102 is formed with a downwardly facing shoulder 104. A bearing 140 is disposed between the shoulder 104 and an upwardly facing surface of the valve 72. The bearing 140 restrains the valve 72 while allowing the valve 72 to rotate freely. Air vents 106 are circumferentially spaced around the ring structure 102 allowing air to cool the valve 72 and bearing 140. Air is drawn through vents 106 by the rotating valve 72. The air passes through a cooling passage 92 in the valve 72 (FIG. 5) cooling the interior of the valve 72. While this embodiment is depicted, the valve 72 could be insulated by ceramics on the bottom surface 74, eliminating the need for this feature.

The manifold 110 (FIG. 3) is mounted on top of the ring structure 102. The manifold 110 includes an exhaust pipe 112 which is axially aligned with the outlet 78 of the exhaust passage 76. A seal 114 fits in a groove in the flanged end 116 of the exhaust pipe 112 to prevent the escape of exhaust gases. Exhaust passage 76 is insulated internally by ceramics or externally with appropriate material to prevent heating the intake air. This insulation along with low exhaust velocities also creates higher exhaust temperatures reducing emission levels. The manifold 110 also includes an annular cavity 120 surrounding a cone-shaped insulating structure 118. Intake openings 122 are circumferentially spaced around the manifold to emit intake air into the annular cavity 120.

As previously indicated, a spark plug 150 is mounted on the valve 72. The spark plug 150 is connected by a conductor 152 to a moving contact 154 on the valve 72. A stationary contact 156 is mounted to the inner surface of the ring structure 102 and is connected by a conductor 158 to the engine's ignition system.

Figure 5:
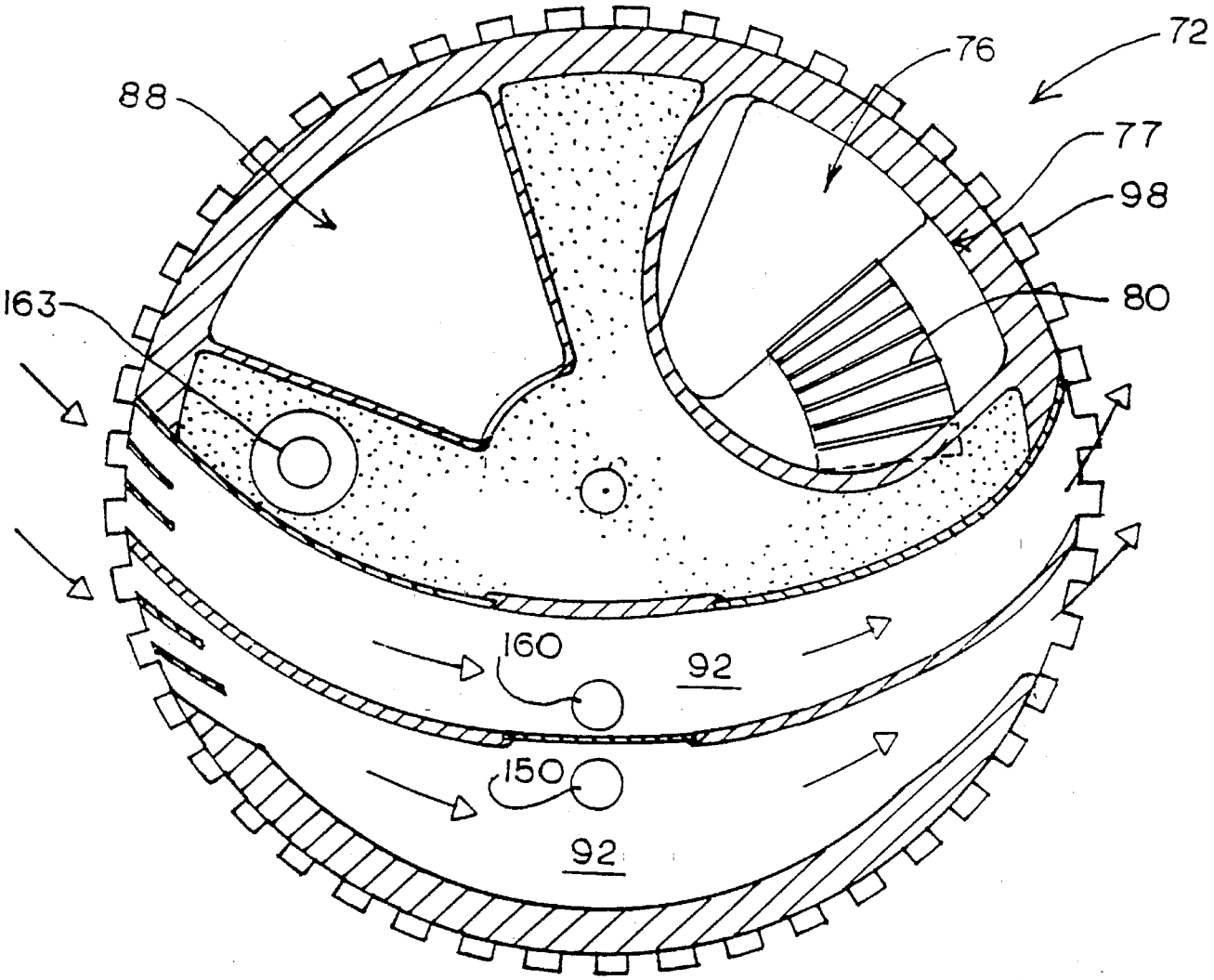
FIG. 5 is a section view of the rotary valve taken through line 5—5 of FIG. 4.

The fuel injector 160 is also mounted in the same cavity 92 as the spark plug 150. The fuel injector 160 is connected by a fuel line 162 and a rotary seal 164 to a fuel pump (not shown ). The fuel line 162 passes through an opening in the shaft 96 of the rotary valve 72. The fuel injector 160 located in the valve 72 is designed to cool the swirl chamber 94 and spark plug 150. An additional fuel injector 163 may be located on valve 72 (FIG. 5). Just after intake outlet 88 closes, injector 163 injects a lean amount of fuel. Then as the first injector 160 approaches the center of the cylinder, injector 160 injects a small amount of the fuel which is immediately ignited by the spark plug 150. This creates a stratified charge which is useful for lean burn conditions. The injection system allows for higher compression ratios and is suitable for use with alternative fuels as well.

Figure 7:
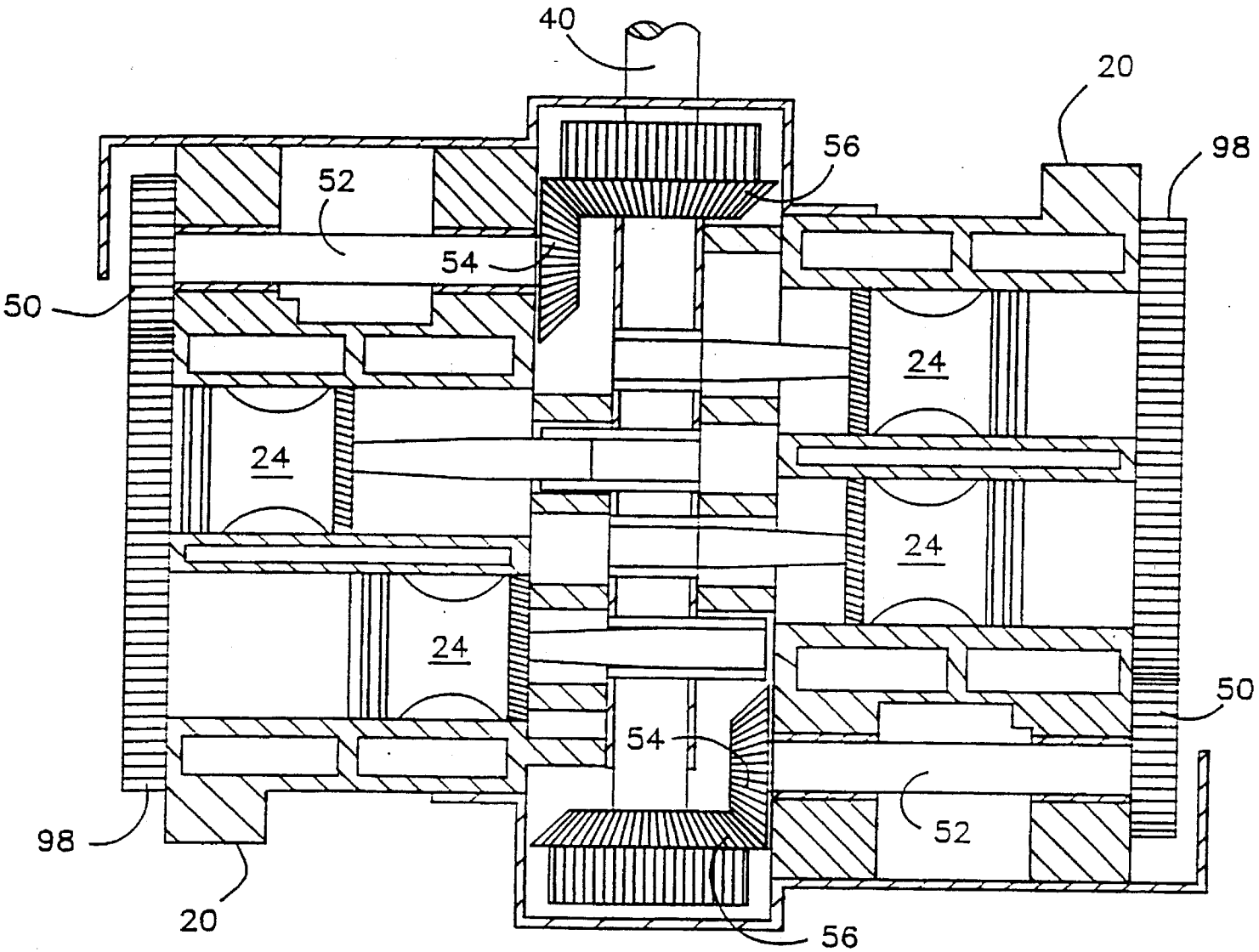
FIG. 7 is a section view of an eight cylinder engine block taken through line 7—7 of FIG. 2 showing two banks of four cylinders at 180° sharing common crankshafts.

The rotation of the valve 72 is synchronized with the crankshaft 40 and pistons 24. The valve 72 is provided with a series of gear teeth 98 and is driven by a pinion gear 50 on the end of a vertical shaft 52 (FIG. 7). A bevel gear 54 is mounted at the opposite end of the vertical shaft 52, which meshes with a second bevel gear 56 on the crankshaft 40. The valve 72 is timed such that the valve 72 rotates once for every two rotations of the crankshaft 40.

In operation, intake air enters the annular chamber of the valve housing through the air filter. As the valve 72 rotates, the intake air enters the inlet 86, passes through intake passage 84 (FIG. 4), and enters one of the cylinders 22 of the engine block while the piston 24 is moving downward. The downward motion of the piston 24 within cylinder 22 creates a partial vacuum within the cylinder 22 that pulls the intake air into the cylinder 22. Pressure within intake 84 is increased by the air scoop effect and the decelerating air column caused by the closing of outlet opening 88. This increased pressure allows the outlet opening 88 to close after piston 24 starts upward, creating higher charge pressures in cylinder 22. Further, this effect is maintained as r.p.m.'s increase, since pressure from the scoop effect increases with increasing rpm's offsetting increasing drag created by increasing air velocities. The bottom 74 of the valve 72 rotates over the cylinder 22 to effectively close the valve 72. The compression stroke begins with the piston 24 moving upwardly within cylinder 22 with the flat bottom 74 of the valve 72 overlying the cylinder 22. The upward motion of the piston 22 compresses the air within the cylinder. Fuel is injected early and late in the compression stroke by fuel injectors 163 and 160. The injection of fuel into the cylinders 22 slightly moderates heat and pressure created by the rising piston 24 during compression. As the piston 24 reaches top dead center, the spark plug 150 rotates towards the center of the cylinder 22. The spark plug 150 ignites the fuel-air mixture within the cylinder 22. Due to the high intake turbulence caused by the valve 72 moving over the top of the cylinder 22 during intake and maintained by the rotating surface of the valve 72 above during compression and the compact chamber design, pre-ignition problems are reduced allowing the use of higher compression ratios. The heat of combustion causes forceful expansion of gases that push the piston 24 downwardly. The downward force is carried through the piston rods 38 to the crankshaft 40 which is given a powerful turn. As the piston 24 reaches the bottom of its power stroke, the exhaust passage 76 rotates over the cylinder 22. The exhaust stroke begins with the upward movement of the piston 24 which forces the burned out gases through the exhaust passage 76 and out the exhaust pipe 112. The compounding fins 80 in the exhaust passage 76 are designed to take advantage of the residual energy of the exhausted gases. The exhaust gases exit between the compounding fins 80 which are mounted at an angle to drive the valve 72.

Perhaps the most significant advantage of the rotary valve is its ability to efficiently transport large volumes of air. Conventional poppet engines typically have effective intake to bore areas of about 25% with the best engines achieving about 30%. With the theoretical maximum of 32%, the main goal of this rotary valve design was to achieve an intake port to bore area at least 30% higher or about 40%. In the presented design, valve openings are not restricted by cylinder size and in fact may exceed the bore area. The intake port to bore area of the engine presented is about 110%, or 3.67 times the best conventional popper engines. Additionally, both the intake and exhaust passages of the rotary valve 72 are short, relatively straight, and of large cross-sectional area. As a result, the valve offers little resistance to the flow of engine gases enabling the valve to maintain its air transport capacity advantage. Therefore, the rotary valve 72 can exceed more than five times the air transport capacity of conventional poppet valve engines. The increased air transport capacity allows the engine to achieve higher r.p.m. levels. Increased r.p.m.'s increase per unit output. Increased per unit output allows engine displacement to be reduced while still maintaining output levels comparable to conventional popper engines. Further, reduced displacement decreases the mass and friction of the piston and connecting rods allowing increased r.p.m.'s. Therefore, depending upon how successfully mass and friction are reduced, r.p.m.'s can be increased several times that of conventional poppet valve engines. Ideally, supercharging or turbo-charging would also be employed to utilize any remaining transport capacity to further increase output. This strategy would allow a dramatically reduced displacement engine to match the maximum output of much larger displacement conventional engines.

Another significant advantage is the greatly improved thermodynamic cycle. Greater air/fuel mixing, direct fuel injection, the use of compact hemispherical bowl-in-piston combustion chambers, and the late introduction of hot valve areas all serve to reduce pre-ignition allowing compression ratios to attain levels as high as 14:1 or 15:1. Also, intake air is transported through an always cool intake portion of the valve minimizing charge heating. This, along with the increased charge pressure created by the intake scoop and closing valve increase total initial charge pressure. Increasing the initial charge pressure and compression ratios both increase mean effective pressure, which results in greater efficiency and output. Adding the recapture of exhaust energy further improves this already highly efficient thermodynamic cycle to levels greater than conventional poppet valve engines.

Another significant advantage of the present invention is that it reduces engine emissions by promoting lean burn conditions. Successful lean burn operation requires a very thorough mixing of air/fuel mixture. The rotary valve 72 of the present invention produces a turbulent flow of engine gases which should result in more effective mixing of air and fuel.

Based on the foregoing it is apparent that the rotary valve engine of the present invention has numerous advantages over conventional poppet valve engines. First, the rotary valve engine increases fuel efficiency as compared to conventional poppet valve engines. The increase in fuel efficiency is attributable to large valve port openings (about four times the size of average conventional engines), cooler air injection temperatures, high degree of mixing of fuel and air, higher compression ratios, higher engine r.p.m.'s, lower pumping losses, lower friction, and the recapture of exhaust energy. Secondly, the rotary valve engine should decrease exhaust emissions by improving fuel efficiency, lowering late cycle combustion temperatures, and increasing exhaust temperatures. Additionally, lower levels of oil in the fuel mixture contribute to lower emissions. Third, the rotary valve engine should be relatively inexpensive to produce as compared to conventional engines. The lower cost is attributable to the compactness of the design and the reduction in the number of parts. Fourth, the engine of the present invention should run smoother with less vibration than conventional engines due to the counter rotating crankshafts and the rotating valve. Finally, the rotary valve is more suitable for future technological improvements. The rotary valve engine can easily incorporate the use of alternative fuels and ceramic materials.

The present invention may, of course, be carried out in other specific ways than those herein set forth without parting from the spirit and essential characteristics of the invention. For example, an eight cylinder engine can be made by disposing two engine blocks back-to-back as shown in FIG. 7 with the cylinders disposed 180 degrees apart and using common crankshafts. The present embodiments are, therefore, to be considered in all respects as illustrative and not restrictive, and all changes coming within the meaning and equivalency range of the appended claims are intended to be embraced therein.

What is claimed is:

1. A rotary valve engine comprising:

a) an engine block having a combustion chamber;

b) a drive member mounted in said combustion chamber;

c) a crankshaft rotatably mounted to said engine block and driven by said drive member;

d) a rotary valve mounted on said engine block;

e) an intake passage formed in said rotary valve for directing intake air into said combustion chamber as said valve rotates;

f) an exhaust passage formed in said rotary valve for exhausting combustion gases from said combustion chamber as said valve rotates;

g) a valve housing mounted on said engine block for enclosing said rotary valve, said valve housing defining an annular intake chamber; and h) at least one intake opening formed in said valve housing and communicating with said annular intake chamber.

2. The rotary valve of claim 1 wherein the rotary valve includes a flat bottom surface overlying said plurality of cylinders such that the fiat bottom surface seals the cylinders.

3. The rotary valve engine of claim 1 wherein said ignition means comprises a spark plug mounted on said rotary valve for igniting said fuel/air mixture in said cylinders in succession as said valve rotates.

4. The rotary valve engine of claim 1 further including a swirl chamber contained in said bottom surface of said rotary valve.

5. The rotary valve engine of claim 1 further including at least one compounding element disposed in the exhaust passage of said rotary valve for recapturing energy from said combustion gases.

6. The rotary valve engine of claim 5 wherein said compounding element comprises a fin which is angularly disposed with respect to the flow of combustion gases through said exhaust passage.

7. The rotary valve engine of claim 1 wherein said rotary valve includes a cooling passage extending through the body of said valve such that cooling air passes through the valve body when the valve rotates.

8. The rotary valve engine of claim 7 wherein the cooling passage in the rotary valve includes one or more vanes for directing air flow through the passage.

9. The rotary valve engine of claim 1 wherein the ratio of the area of the intake valve opening to the area of the cylinder is at least 40%.

10. A rotary valve engine comprising:

a) an engine block including a combustion chamber;

b) a crankshaft mounted within the engine block;

c) a drive member movably mounted within the combustion chamber and connected to the crankshaft for rotating the crankshaft;

d) a rotary valve mounted on the engine block;

e) an intake passage formed in said rotary valve for directing intake air into said combustion chamber as the rotary valve rotates;

f) an exhaust passage formed in said rotary valve for exhausting combustion gases from said combustion chamber as said rotary valve rotates; and g) a fuel injector mounted on said rotary valve and rotating with said rotary valve, said fuel injector for injecting fuel into said combustion chamber wherein said fuel mixes with said intake air to form a combustible mixture.

11. The rotary valve engine of claim 10 wherein said combustion chamber comprises a cylinder and said drive member includes a piston disposed within said cylinder.

12. The rotary valve engine of claim 11 including a plurality of cylinders and pistons equally spaced from the axis of rotation of said rotary valve.

13. The rotary valve engine of claim 12 wherein said rotary valve includes a generally flat bottom surface having a swirl chamber formed therein.

14. A rotary valve engine comprising:

a) an engine block having at least one cylinder;

b) a reciprocating piston mounted in said cylinder;

c) a crankshaft rotatably mounted to said engine block;

d) a connecting rod connecting said piston to said crankshaft to rotate said crankshaft as the piston reciprocates in said cylinder;

e) a rotary valve mounted on said engine block, said rotary valve including a generally flat bottom surface overlying said cylinder such that the rotary valve seals the top of said cylinder;

f) a seal surrounding said cylinder;

g) a cam-actuated hydraulic pressure system for providing a variable pressure to bias said seal into engagement with the bottom surface of said rotary valve to form a tight seal;

h) an intake passage formed in said rotary valve for directing intake air into said cylinder; and i) an exhaust passage formed in said rotary valve for exhausting said combustion gases from said cylinder.

15. The rotary valve engine of claim 14 wherein said combustion chamber comprises a cylinder and said drive member includes a piston disposed within said cylinder.

16. The rotary valve engine of claim 15 including a plurality of cylinders and pistons equally spaced from the axis of rotation of said rotary valve.

17. The rotary valve engine of claim 16 wherein said rotary valve includes a generally flat bottom surface having a swirl chamber formed therein.

* * * * *